United States Patent [19]

Boldrini

[11] 3,969,881

[45] July 20, 1976

[54] MACHINES FOR THE PRODUCTION OF CHENILLE YARNS AND SPOOLING THEREOF

[76] Inventor: Luigi Boldrini, Via dell'Olivuzzo 54, Florence, Italy

[22] Filed: June 17, 1975

[21] Appl. No.: 587,653

[30] Foreign Application Priority Data

Dec. 23, 1974 Italy ..... 9656/74

[52] U.S. Cl. ..... 57/24

[51] Int. Cl.[2] ..... D02G 3/42

[58] Field of Search ..... 57/24, 143, 157 R, 156

[56] References Cited

UNITED STATES PATENTS

| | | | |
|---|---|---|---|
| 1,687,942 | 10/1928 | Kriegl | 57/24 |
| 1,927,292 | 9/1933 | Neff et al. | 57/24 |
| 2,576,430 | 11/1951 | Weller | 57/24 |
| 2,684,565 | 7/1954 | Hortal | 57/24 |
| 3,357,166 | 12/1967 | McCarthy | 57/24 |
| 3,645,078 | 2/1972 | Roberts | 57/24 |
| 3,777,464 | 11/1973 | Gross | 57/24 |
| 3,861,128 | 1/1975 | Whitaker | 57/24 |
| 3,869,850 | 3/1975 | Gross | 57/24 |

*Primary Examiner*—John Petrakes

*Attorney, Agent, or Firm*—McGlew and Tuttle

[57] ABSTRACT

The machine comprises plural forming units each operable to produce two chenille yarns each formed by two binding yarns twisted together to bind short sheared lengths of an "effect" or "fancy" yarn. Each forming unit has, associated therewith, a pair of spindles mounted for rotation about substantially vertical axes and each operable to wind one of the formed chenille yarns thereon. Two pairs of binding yarn supplies are provided for forming each pair of chenille yarns, one pair of binding yarn supplies feeding from above and the other pair of binding yarn supplies feeding from below. Each unit includes a respective motor-driven control shaft in driving relation with the forming unit and with the associated wind-up spindles, and a rotary bell having an axial passage through which an effect yarn is fed formed with two eccentric guide bushes extending therethrough through which yarn is led. A winding and sizing member is mounted beneath each bell member and is formed by two spaced profile portions converging upwardly toward an inverted triangle-shape leg portion and defining respective outwardly facing concave surfaces merging with opposite surfaces of the leg portion, the profile portions defining a slot therebetween extending into the leg portion. A shearing blade disposed symmetrically in the slot between the profile portions shears the turns of effect yarn to form the sheared lengths thereof. A feed roller is engaged with each concave surface to entrain a respective half of the sheared turns of effect yarn, and one of the two upper binding yarns is fed between each feed roller and the adjacent concave surface. Each profiled portion has a hole therethrough and the two lower binding yarns are fed through these holes.

10 Claims, 12 Drawing Figures

V
V
89
124
86
92
92A
88
96
92
120A
30
100
94
76
64
78
62
66
58
84A
100
L2
68A
30
120
126
88
L1
86
96
124
89
9

40

40A
E
42
44A
42
44
54
44B
E1
56
30
F6
VII
IX
120A
84
F6
120
64
L1
100
F1
68
90
30
90
VII
IX
L2
L2

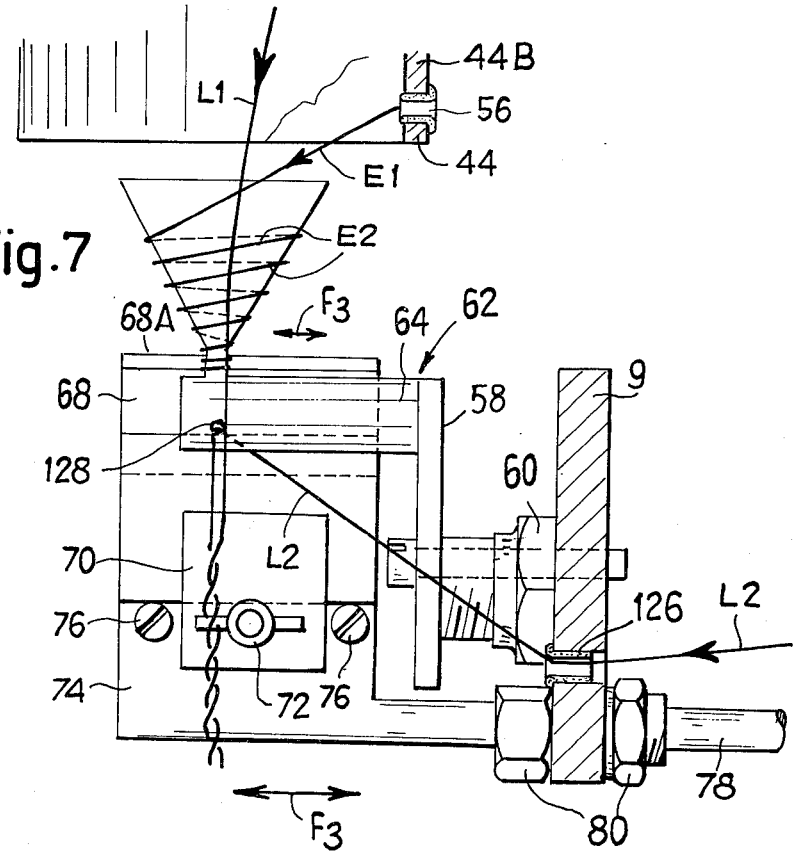
Fig.7
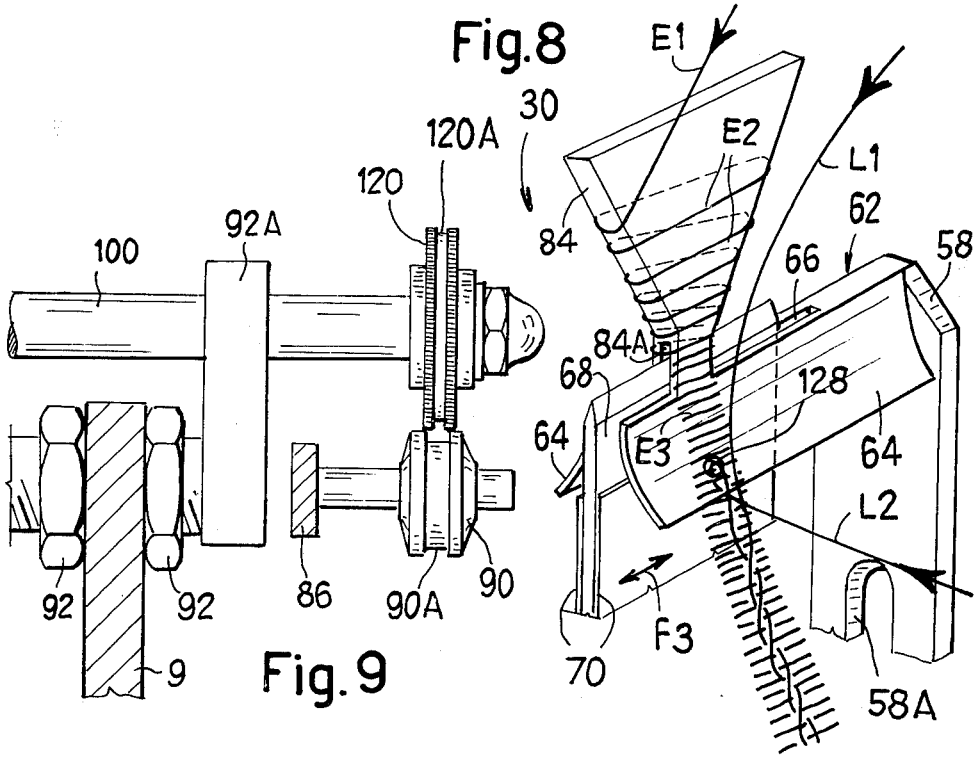
Fig.8
Fig.9

Fig. 12
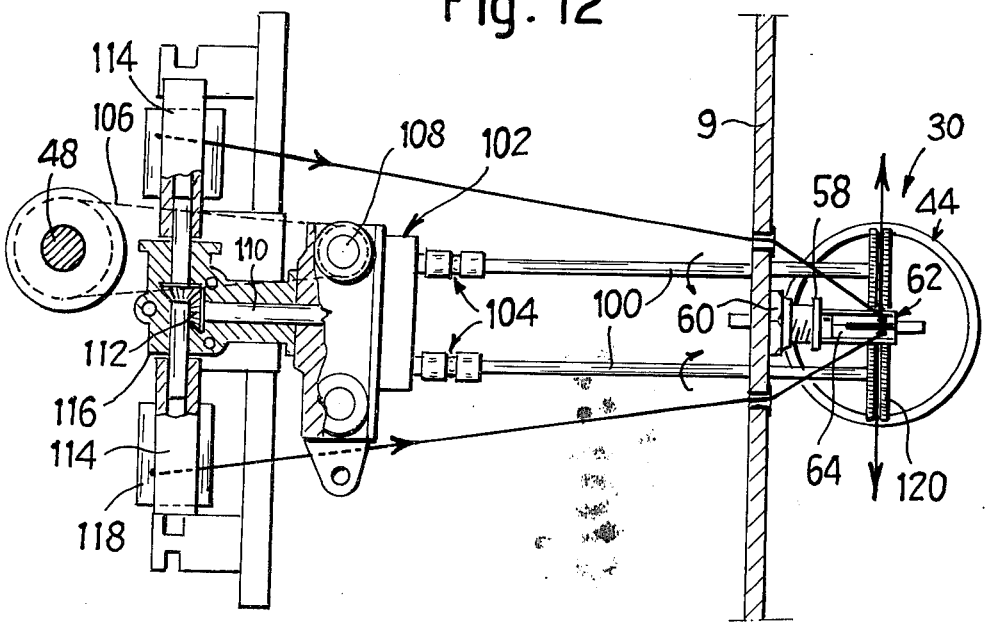
Fig.11
Fig.10
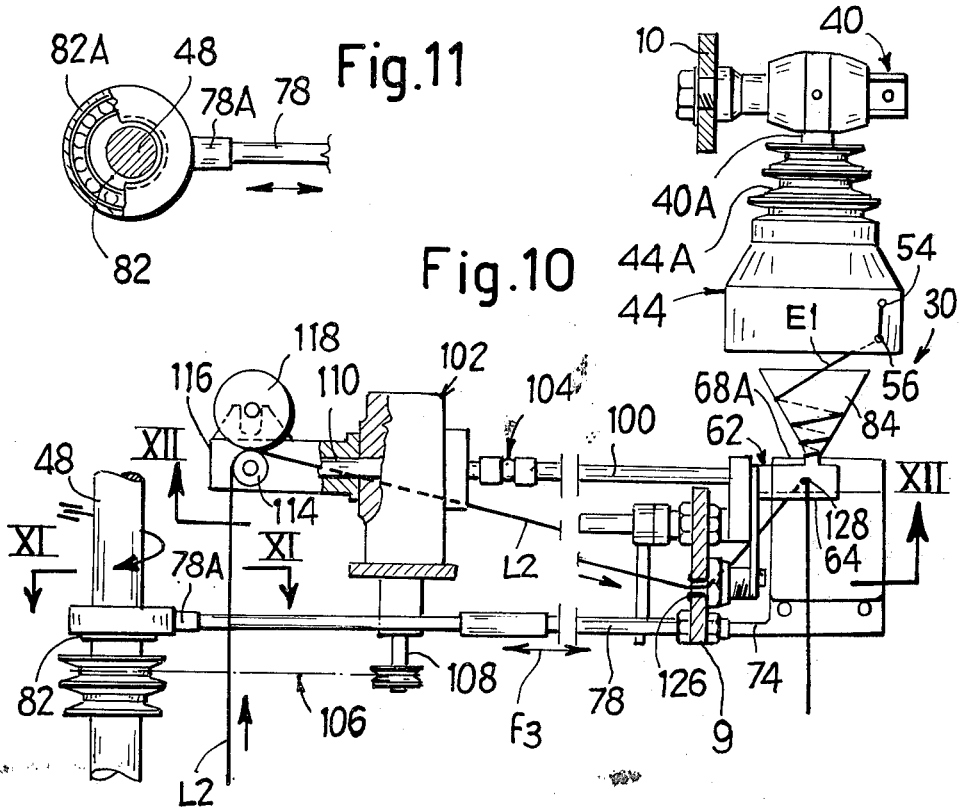

MACHINES FOR THE PRODUCTION OF CHENILLE YARNS AND SPOOLING THEREOF

FIELD OF THE INVENTION

This invention relates to a machine designed for producing pairs of chenille yarns, each formed by two binding yarns twisted together to bind short sheared lengths of an "effect" or "fancy" yarn, by twisting of the binding threads together with the sheared lengths of the effect or fancy yarn engaged therebetween. The machine of the present invention is designed as an improvement upon known machines for producing chenille yarns.

SUMMARY OF THE INVENTION

In accordance with the invention, the machine includes an upright frame for supporting chenille yarns twisting spindles and mounting a plurality of such spindles rotating about vertical axes and arranged in pairs. A horizontal bank is mounted on the frame for vertical movement relative to the spindles, and is formed with annular tracks each coaxial with a respective spindle, each track serving to guide an annular slider entrainable by the yarn to be wound on the respective spindle. The frame mounts forming units, each associated with a pair of wind-up spindles, and each operable to produce two chenille yarns. Each unit has associated therewith four bobbins or spools of binding yarn, two of these being mounted on the frame above the forming unit for feeding downwardly thereto and the other two spools being mounted on the frame for feeding upwardly toward the forming unit. Each forming unit includes an electric motor-driven, vertically oriented control shaft rotatably mounted on the frame and connected, by driving means, to the forming unit and to the associated pair of wind-up spindles.

Each forming unit further includes a rotary bell member formed with an axial passage therethrough for the effect yarn and having a depending cylindrical skirt mounting two yarn-guide bushes therethrough through which the effect yarn is threaded in respective opposite radial directions. Immediately below each bell member, there is a winding and sizing member for the lengths of effect yarn. Each winding and sizing member includes two spaced profiled portions converging upwardly toward an inverted triangle-shape leg portion, and defining two outwardly facing concave surfaces merging with respective opposite surfaces of the inverted triangle leg portion, the profiled portions defining a slot therebetween extending into the leg portion. By rotation of the associated bell member, each effect yarn is wound on the associated winding and sizing member to form turns around the triangular leg portion thereof, these turns moving downwardly along the leg portion. A shearing blade is disposed symmetrically in the slot between each pair of profile portions and projects into the associated leg portion to shear the turns of effect yarn wound on the latter to form the sheared lengths of effect yarn, the respective halves of each severed turn of effect yarn moving downwardly along the adjacent concave surface.

A pair of feed rollers are provided for each forming unit, and each feed roller is engaged with a respective concave surface to entrain a respective half of the sheared turns of the effect yarn. Means are operable to feed, between each feed roller and the adjacent concave surface, the upper one of the two binding yarns of each chenille yarn which is clamped by the feeding rollers against the cut lengths of effect yarn. Each profile portion has a hole therethrough opening into its concave surface, and positive feed means are operable to feed the lower of the two binding yarns of each chenille yarn through this hole.

A supporting means for each feed roller is oscillatably mounted on the frame and associated with resilient means operable to bias the feed roller toward the adjacent concave surface, each supporting means having an operational arm actuable to disengage the associated feed roller from the adjacent concave surface. An auxiliary roller is cooperable with each feed roller and is rotatably mounted on the supporting means adjacent the lower end of the associated concave surface, and is biased toward the feed roller to exert a traction on the binding yarn. Each feed roller and its associated auxiliary roller feeds the two binding yarns, between which the sheared lengths of effect yarn are engaged, over a free span to the associated annular slider for twisting of the two binding yarns about each other by interaction of the associated spindle and the annular slider.

Each feed roller advantageously has an annular channel or groove formed thereon to guide the binding threads, and each auxiliary roller is formed with a groove cooperable with the groove in the feed roller to define a channel whose width corresponds substantially to the length of the effect yarn portions. The surface of the feed roller which, before cooperating with the auxiliary roller, slides on the adjacent concave surface, is formed with knurled grooves extending parallel to its axis.

The support means of each feed roller is designed as a rocker arm lever carrying, at one end, the feed roller and, at its pivotal mounting, the cooperating auxiliary roller. The other end of the support means forms an operational arm adjacent the corresponding operational arm of the support means of the other feed roller associated with the same winding member, whereby the two feed rollers of a unit may be easily manually brought into inoperative relation with the adjacent concave surfaces.

An object of the invention is to provide an improved machine for producing pairs of chenille yarns each formed by two binding yarns twisted together to bind short sheared lengths of an effect yarn therebetween.

Another object of the invention is to provide such a machine which is simple in construction and easily controllable.

A further object of the invention is to provide such a machine including a plurality of forming units each operable to produce two chenille yarns, each formed by two binding yarns twisted together to bind short sheared lengths of an effect yarn therebetween.

For an understanding of the invention, reference is made to the following description of a typical embodiment thereof as illustrated in the accompanying drawings.

BRIEF DESCRIPTION OF THE DRAWINGS

In the Drawings:

FIG. 7 is an elevation view, partly in section, illustrating, on a reduced scale, a detail of FIG. 3 taken along the line VII—VII of FIG. 3;

FIG. 8 is a perspective view illustrating the active members for forming the chenille yarn;

FIG. 9 is a sectional view taken along the lines IX—IX of FIGS. 3 and 6;

FIG. 10 is an elevation view, partly in section, illustrating, to a larger scale, a detail of FIG. 2;

FIG. 11 is a horizontal plan view, partly in section, on the line XI—XI of FIG. 10; and FIG. 12 is a horizontal sectional view, looking upwardly, taken along the line XII—XII of FIG. 10.

DESCRIPTION OF THE PREFERRED EMBODIMENT

Figure 1:
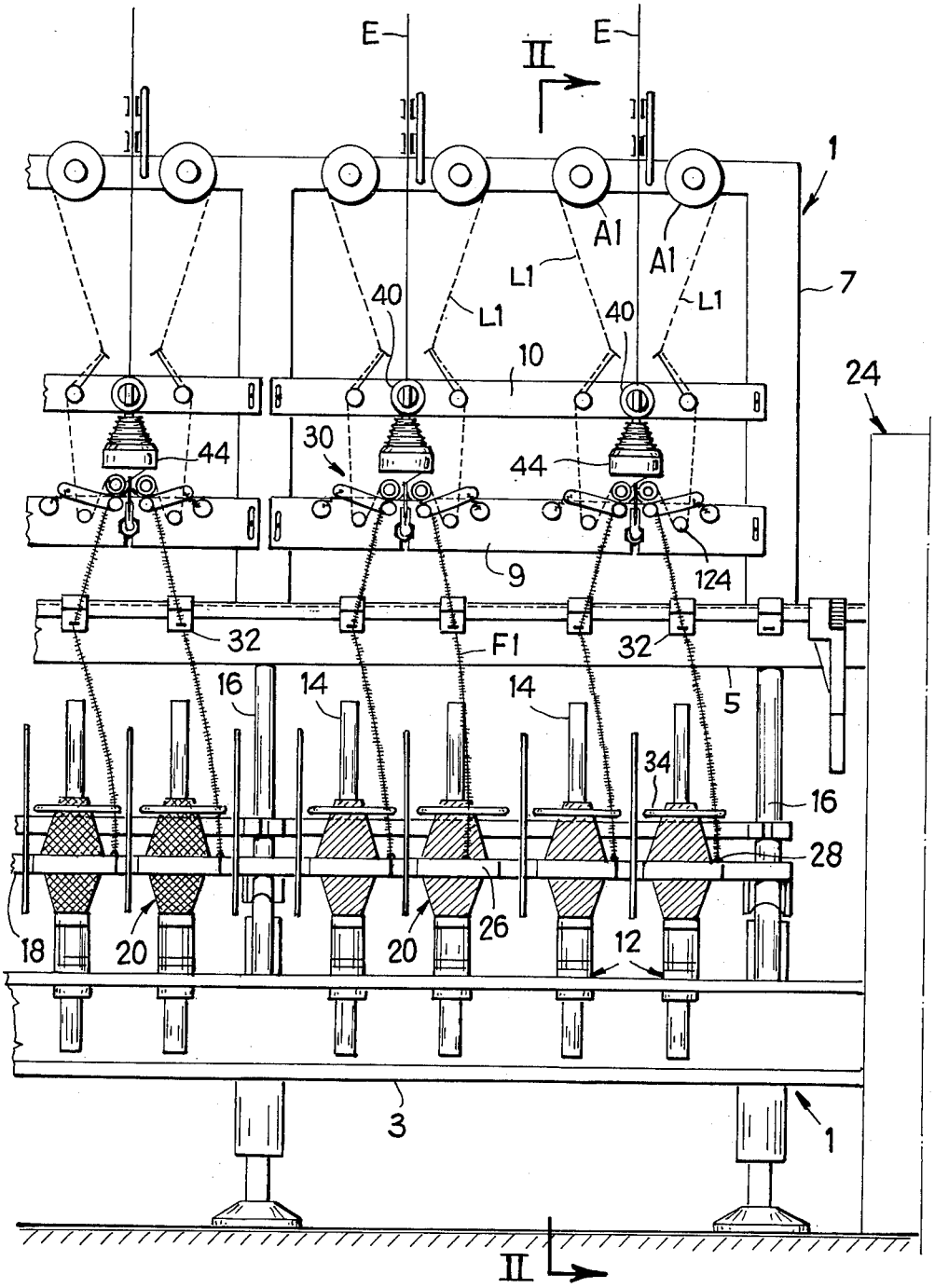
FIG. 1 is a partial front elevation view, and a partially schematic view, of a machine embodying the invention.
Figure 2:
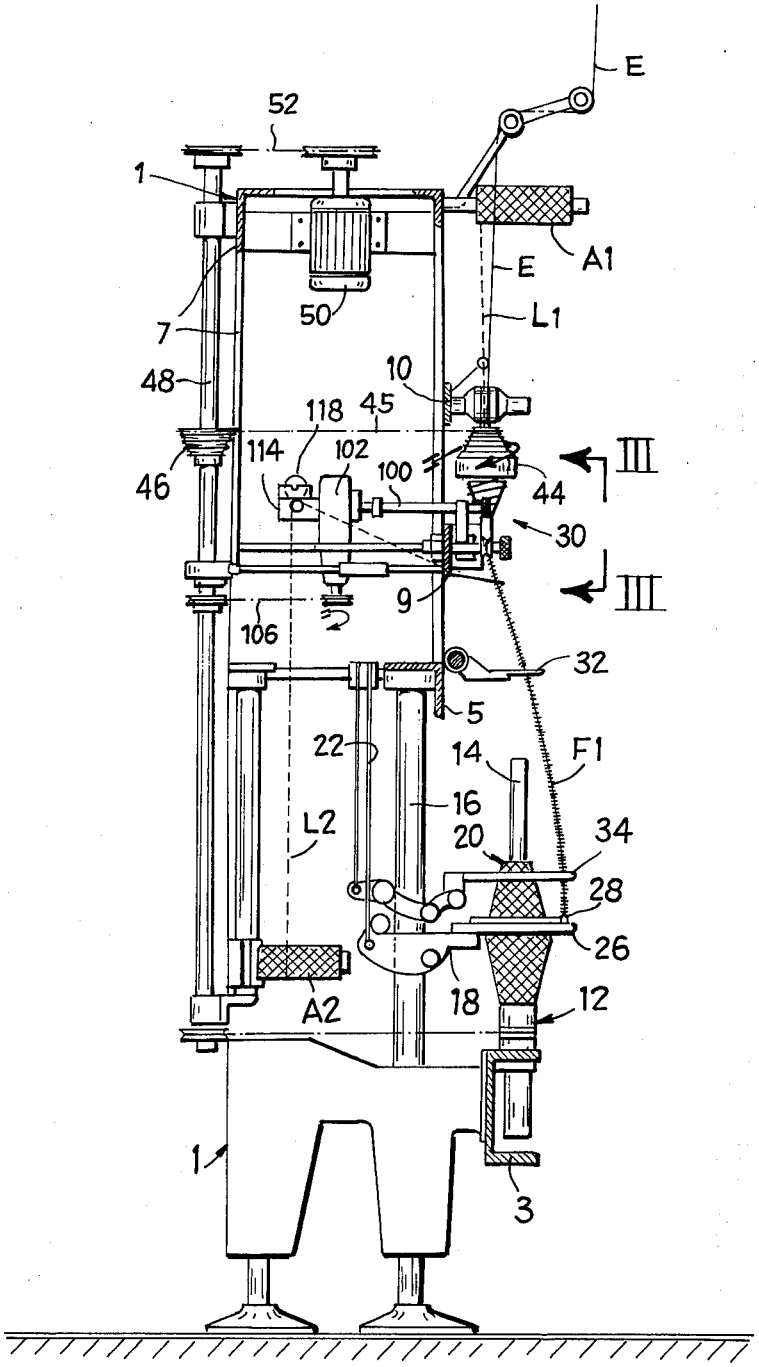
FIG. 2 is a vertical sectional view taken along the line II—II of FIG. 1.

Referring first to FIGS. 1 and 2 of the drawings, a main structure 1 forms a frame including cross-beams 3 and 5 and an upright 7 formed with cross-beams 9 and 10. Cross-beam 3 has mounted therein, for rotation about vertical axes, several units 12 having spindles 14 for winding-up the chenille yarn in bobbins from which the chenille yarn may be easily unwound. The main structure or frame 1 also includes vertical sliding ways 16 for a horizontal bank 18 which is cyclically vertically reciprocated in such a manner as to form the turns of the chenille yarn winding on the spindles 14, and thus to form the bobbins 20. The bank 18 may be vertically reciprocated by means of a control means 22 forming part of a control system 24, of a well-known type, which is arranged at one side of the frame 1, as viewed in FIG. 1. Through the medium of the drive system or control means 22, there is obtained a vertical reciprocation of bench 18 as well as a gradual upward movement of the bench by the effect of the piling gradually obtained in the yarn, for the winding frustum-cone front of the yarn on spindles 14, on which front the yarn turns are to be formed.

Bench 18 carries, in coaxial relation with each unit 12, an annular track 26 through which the associated spindle projects as does also the bobbin 20 being formed. Each track 26 is designed to guide, for angular sliding, an annular slider 28 having an eyelet formed therein and through which the yarn, being wound, extends slidably. As illustrated in FIGS. 1 and 2, this yarn reaches each slider 28 over a free span F1 from the associated chenille yarn forming unit 30, each forming unit 30 corresponding to a respective guide track 26. The yarn in span F1 is guided by a yarn guide 32 substantially coaxial with the rotational axis of the associated unit 12 and located above the upper end of spindle 14. The yarn in span F1 is additionally guided by a ring 34 coaxially aligned with, and spaced above, annular track 26 and advantageously moving with bank or bench 18 and adjustable relative to the associated track 26. Yarn guide 32 and ring 34 are provided for the purpose of restricting the horizontal dimension of the so-called "baloon" which is described by the yarn in span F1 by the effect of the "return" operative on the yarn of unit 12 and by the spindle 14 which rotate. This "return" causes, by entraining, through the yarn, sliding of slider 28 along annular track 26 around bobbin 20 being formed. Thereby, there is obtained a twist of the supplied material.

Each of the two chenille yarns formed by device or unit 30 is constituted by two core or binding threads and one or several effect yarns, which latter are sheared to supply a plurality of substantially transversely extending lengths or portions. As each unit 30 is arranged to form two chenille yarns, two spans F1 for the two associated spindles 14 are formed side by side. The two core or binding threads of each chenille yarn are twisted together with the twists imposed thereon by the unit 26, 28, 12.

Each unit 30 has associated therewith two pairs of bobbins A1 mounted on the upper portion of frame one and two pairs of bobbins A1 mounted on the lower portion of the frame. The upper bobbins A1 feed core or binding yarns L1 to the unit 30, while the lower bobbins A2 supply core or binding yarns L2 to the forming unit 30. Each forming unit 30 also has fed thereto an effect yarn E which is supplied from a reservoir or bobbin, which has not been shown, one effect yarn being supplied to each unit 30. Each unit 30, operable to form two chenille yarns, includes a support 40 mounted on cross-beam 10 and having extending therethrough and downwardly therefrom a vertically oriented tubular shaft 40A, shown in FIG. 6, and which supports, by means of antifriction bearings 42, a rotatable bell member 44. As best seen in FIG. 2, the bell member 44 of each unit 30 is rotated through endless belt means 45 engaging pulley grooves 44A formed in member 44 and also engaging corresponding multiple-grooved pulleys 46 secured to a vertically oriented control shaft 48. A respective conrol shaft 48, which is vertically oriented, is rotatable supported by frame 1 for each unit 30 and is rotated by an electric motor 50 through a drive 52. The drive 44A, 45, 46 may have a transmission ratio adjustable or modified in accordance with the position in which belt 45 is assembled on the different diameter pulley grooves.

Bell member 44 has a depending cylindrical skirt 44B formed with an axially spaced pair of holes provided with respective packing bushes 54 and 56. Effect yarn E is passed through tubular member 40A, then radially outwardly through bush 54 and radially inwardly through bush 56, the yarn E extending from bush 56 toward the interior of the skirt or rim 44B with a trajectory E1.

Figure 5:
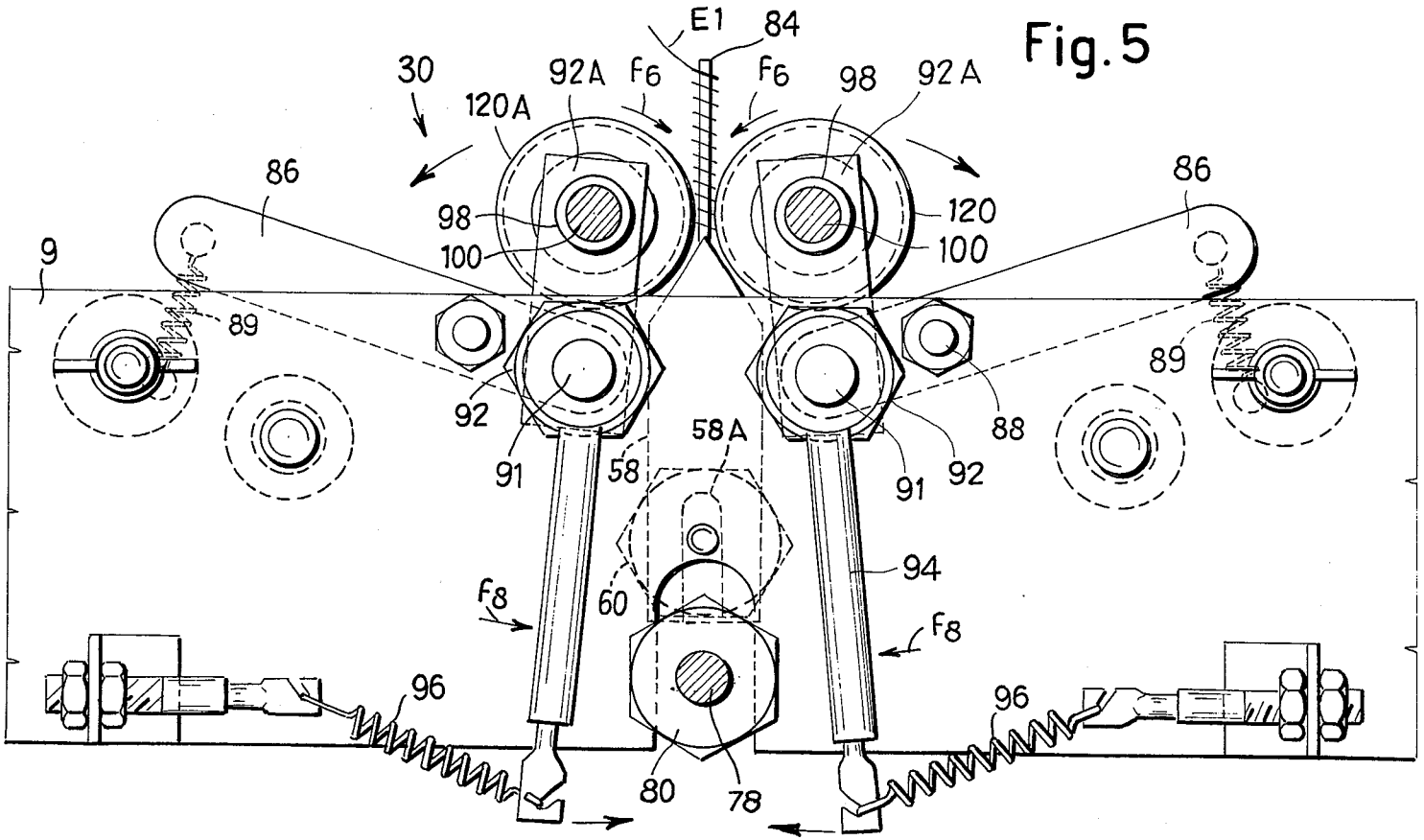
FIG. 5 is a rear elevation view corresponding to FIGS. 3 and 4, constituting a view taken along the line V—V of FIG. 4.

Each forming unit 30 includes a stirrup member 58, shown in FIG. 7, which is adjustably mounted on cross-beam 9 and secured thereto by means of clamping means, such as a clamping nut 60. As best seen in FIG. 8, each stirrup member 58 is adjustable in position by virtue of an elongated slot 58A, which is also shown in FIG. 5. Furthermore, each stirrup 58 includes a bracket portion 62 with two opposite arcuate walls or profiled portions 64 which converge upwardly and diverge downwardly, thus providing concave surfaces which face outwardly away from each other. The two profiled portions 64 are unitary with each other adjacent stirrup 58 but otherwise have formed therebetween a slot 66 within which there is located a shearing blade 68. Blade 68 lies in a vertical plane which extends perpendicularly to the plane including the associated pair of spindles 14, and has a horizontal shearing edge 68A which projects slightly above the slot 66. Blade 68 may reciprocate in the direction of the double arrow *f*3 and, for this purpose, the blade is borne between two plates 70 clamped to each other by a screw member 72 and against a support 74. Adjustable threaded pins 76 define the position of the plates 70, and thus of the blade 68, as to its level and inclination.

Support 74 is borne by a stem 78 which extends horizontally and parallel to shearing edge 68A, stem 78 being guided slidably in a guide support 80 assembled on cross-beam 9 beneath clamping member 60 of stirrup 58. Stem 78 extends substantially to control shaft 48, and has an articulated and resiliently yieldable portion 78A provided on its end in engagement with an eccentric member 82 on shaft 48, as best seen in FIGS. 10 and 11, so as to follow the motion of the eccentric, through the medium of an interposed antifriction bearing 82A. Thereby, there is imposed on stem 78 a reciprocating motion in the direction of the double arrows *f*3, and this reciprocating motion is also thus imposed on shearing blade 68.

Above the two arcuate walls 64 and borne thereby, there is a shaped winding member 84, which is in the form of an inverted triangle with a slotted leg portion 84A which is joined to the edges of the slot 66 defined by profiled portions 64. Slot 66 is substantially elongated in leg 84A, in the lower portion of shaped member 84, in such a manner as to accommodate blade 68 and particularly the shearing edge 68A thereof projecting slightly from slot 66. Upon rotation of bell member 44, which is located above winding member 84, effect yarn E1, emerging from bush 56 toward the interior of the skirt 44B, is wound on winding member 84 to form a series of turns E2 which embrace slidingly the profiled member 84 and thus descend onto leg 84A. On the leg 84A, effect yarn turns E2 are sheared to form a plurality of portions or lengths E3, by shearing edge 68A of blade 68. These lengths are used in a manner described hereinafter and guided in a manner also as described hereinafter. It is to be noted that lengths E3 are provided by the severed halves of the loops E2 and each half is guided along a respective outer concave surface of the profiled portions 64.

Figure 3:
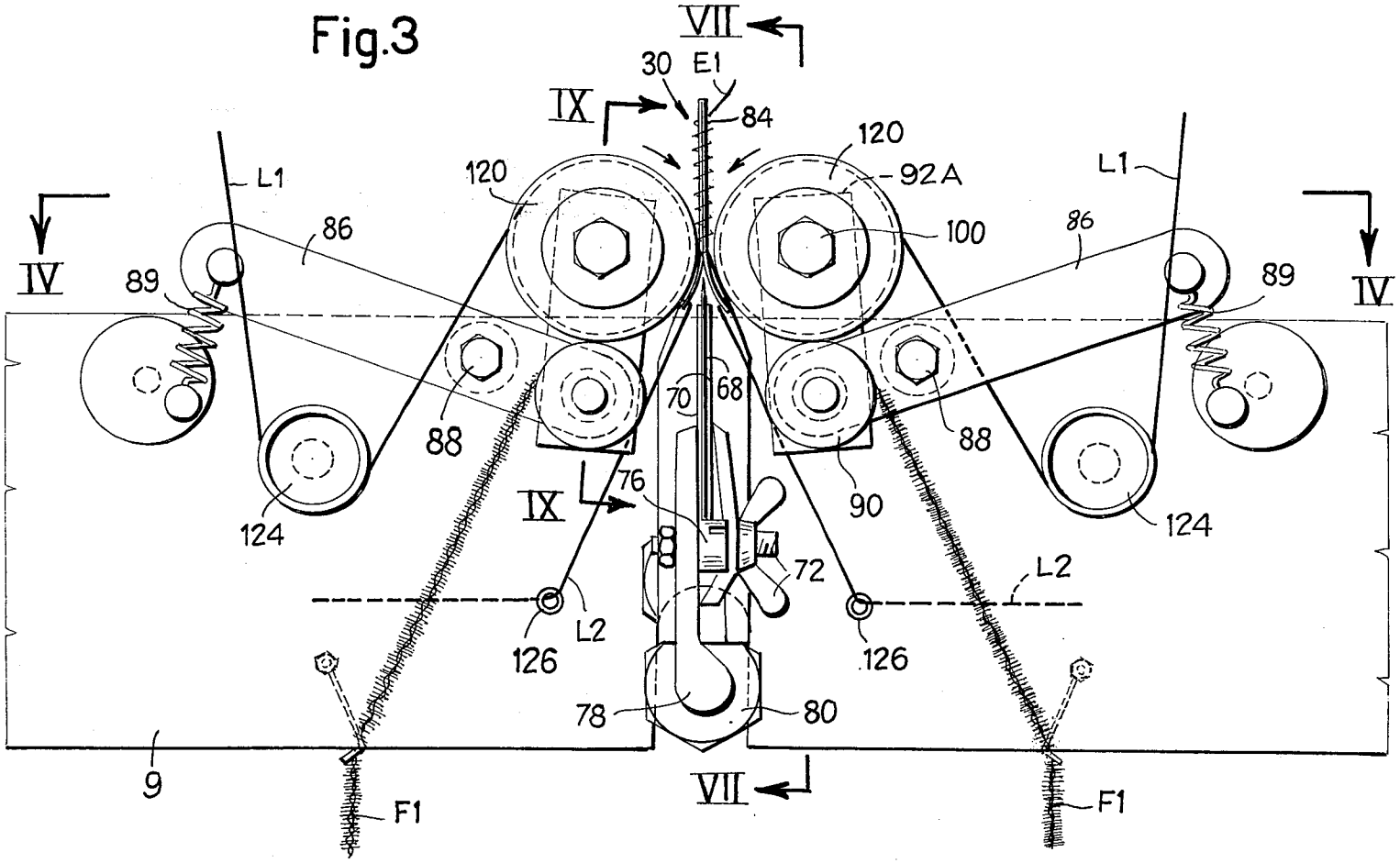
FIG. 3 is a partial elevation view, to an enlarged scale, illustrating a detail of FIG. 1 as seen from the line III—III of FIG. 2.
Figure 4:
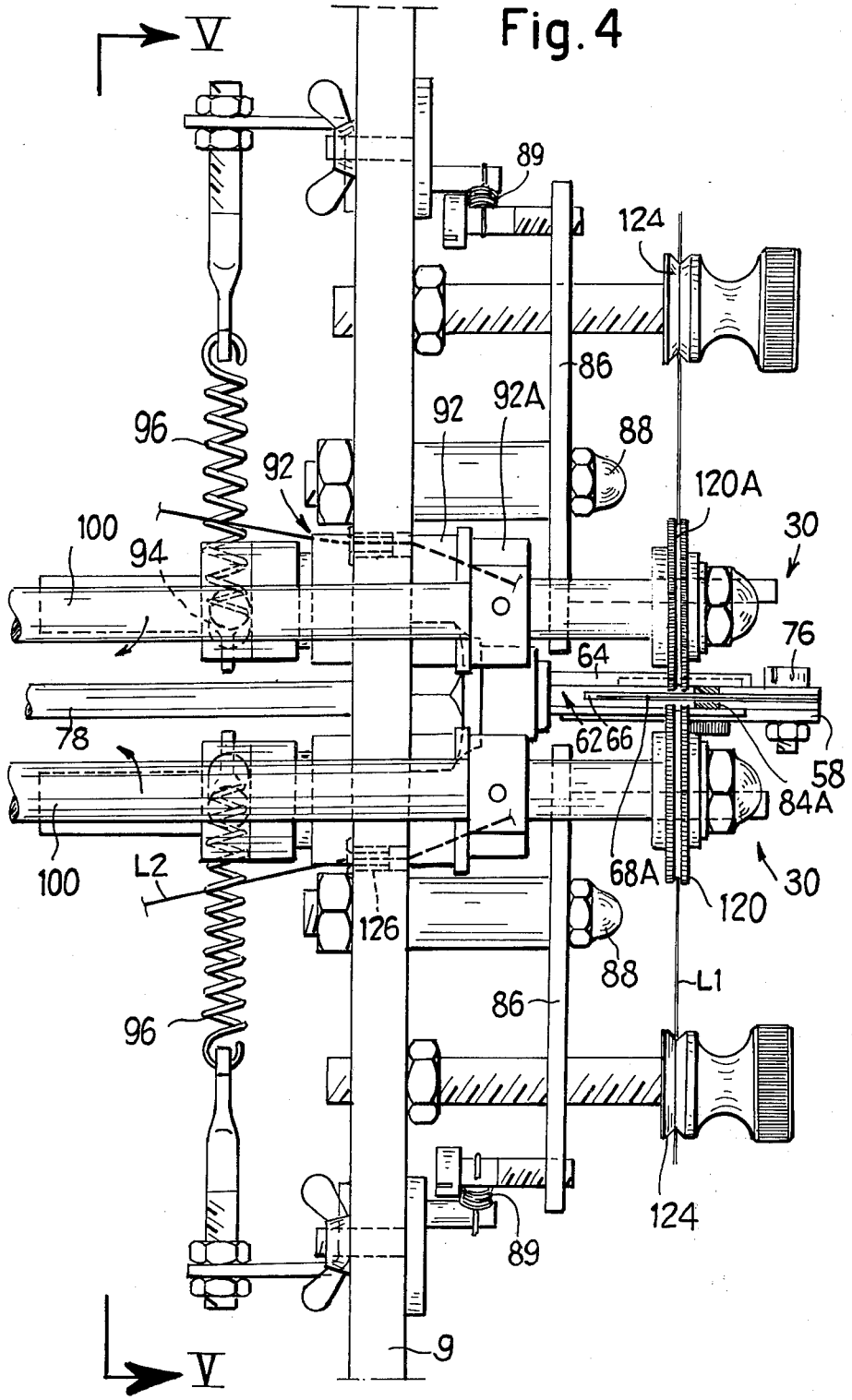
FIG. 4 is a plan view taken along the line IV—IV of FIG. 3.

Referring more particularly to FIGS. 3, 4 and 5, on that side of the plane of cross-beam 9 opposite to the side where blade 68 is located, there are assembled two oscillatory supports 86 which are pivoted, intermediate their ends at a pivot 88, to beam 9 which are biased by means of small springs 89 to diverge from each other. On the inner and converging ends of arms 86, there are assembled pressure rollers 90. Supports 92, which are rectangular in elevation, are pivoted to beam 9 about pivots 91, and are provided with downwardly extending tails or legs 94. Tails or legs 94 are biased, by springs 96, to diverge from each other to impose, on the upper ends 92A of supports 90, a bias toward each other. Bearings 98 are provided at the upper ends 92A of oscillatory supports 92, as best seen in FIG. 5, and support respective shafts 100 which extend substantially horizontally and are rotated, from a control box 102 shown in FIGS. 10 and 12, through joints 104.

A belt drive 106 engaged about a pulley on control shaft 48 drives a pulley secured to the lower end of a shaft 108 of control box 102. In a manner which has not been shown but which is obvious to one having ordinary skill in the art, motion is transmitted from shaft 108 to a pair of front output shafts which actuate shafts 104 and thus shafts 100 to rotate in respective opposite directions. A third output shaft 110 extends from control box 102 and, through a pair of bevel gears 112, actuates two rollers 114 positioned on the opposite sides of a support 116 for shaft 110. Above rollers 114, pressure rollers 118 are rotatably mounted and guided, the pressure rollers 118 being easily raised.

Figure 6:
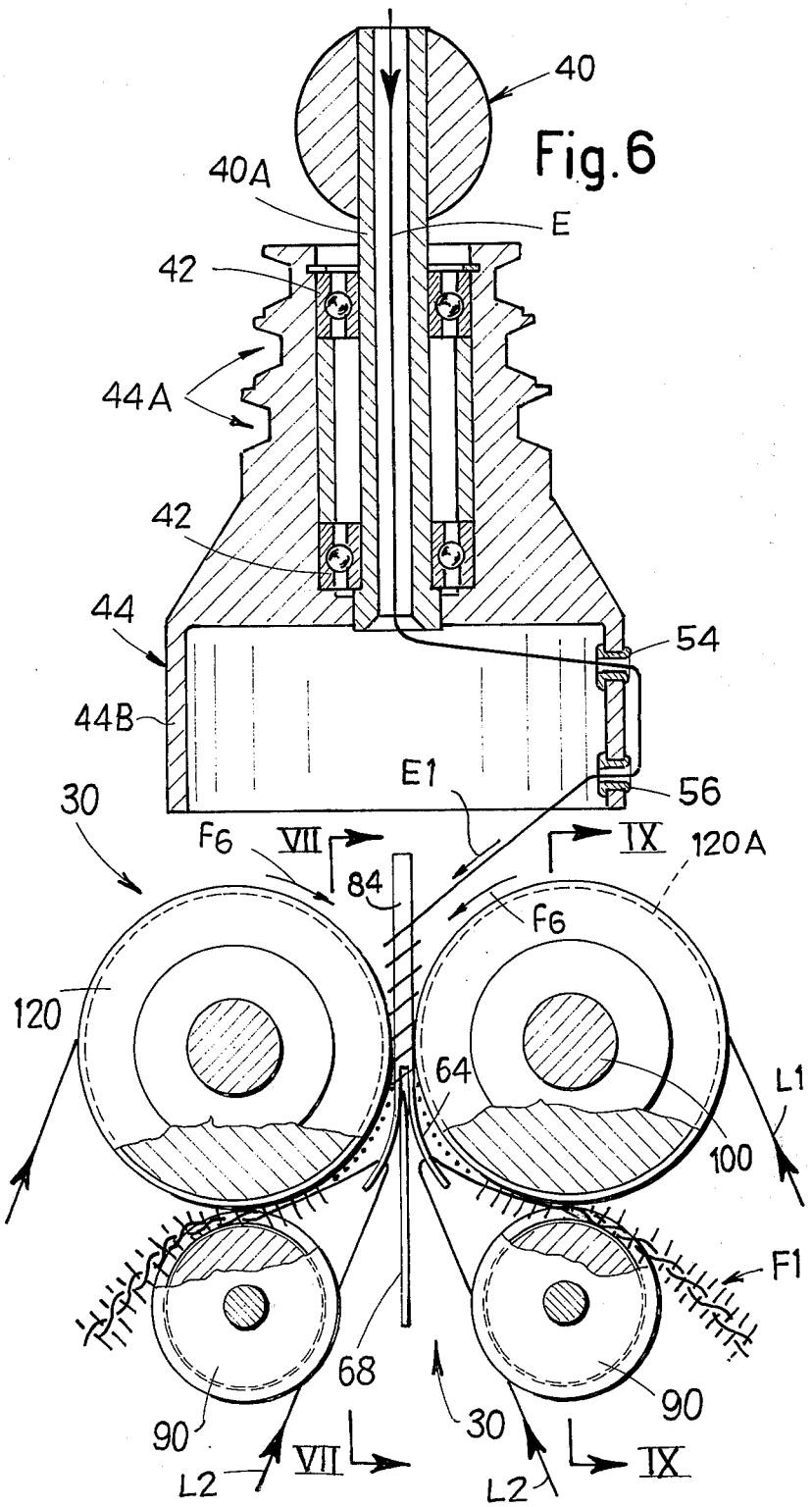
FIG. 6 is a greatly enlarged view, partly in section, illustrating a detail of FIG. 1 and showing the members forming the chenille yarn.

Considering FIGS. 3, 5 and 6, the rotational direction of shafts 100 is that indicated by the arrows *f*6. Two small knurled feed rollers 120, actuated by shafts 100, are operated in the same direction as the arrows *f*6, these rollers having knurled grooves parallel to their axes. Each roller 120 also has a circumferential groove or channel 120A similar to the circumferential groove or channel 90A of the rollers 90. Grooves 120A are designed to at least guide the binding threads L1. On the other hand, grooves 90A are defined by axially spaced ribs which are spaced apart a distance corresponding to the length of the effect yarn portions such as the portions E3, in order to center these portions.

The several fed yarns reach the working members of the chenille yarn forming units 30 in a manner which will now be described. Binding yarns L1 from the reservoirs or bobbins A1 at the upper end of the upright 7 of frame 1 are trained around pulleys 124, or the like, and are then directed to grooves 120A of feed rollers 120. Feed rollers 120 are biased by springs 96 to engage the outer concave surfaces of the profiled portions 64. The feed rollers 120 also graze the opposite surfaces of leg portion 84A of the shaped winding member 84 and, through their knurled peripheries, engage the two sets of short sheared lengths E3 sheared from the effect yarn E1 by the cutting edge 68A of blade 68, during reciprocation of the blade. These lengths E3 of the effect yarn are confined between the concave surfaces of profiled members 64 and the adjacent rollers 120, and thus between the concave surfaces and the respective yarns L1 in the grooves 120A of the feed rollers 120.

Binding yarns L2 from the reservoir or bobbins A2 on the lower portion of frame 1 are guided between feed rollers 114 and 118, as shown in FIGS. 10 and 12, and pass through guide bushes 126 in cross-member 9. The yarns L2 are then directed between the two profiled members 64 to respective holes 128 formed in these profiled members and opening into the concave outer surfaces thereof. This is shown more particularly in FIGS. 7 and 8. The binding yarns L2 issuing from holes 128 are positioned between the concave outer surfaces of the profiled members 64 and the sheared lengths E3 of the effect yarn. Consequently, sheared lengths E3, while they are entrained by feed rollers 120 and yarns L1 and L2, are located between yarns L1 and L2, constituting the binding yarns.

Units 12 of spindles 14 are rotated by the driving connection thereof with the control shaft 48, as shown in FIG. 2, such as an endless belt drive trained over pulleys, and thus rotate to entrain annular sliders 28 engaged with annular tracks 26, with a typical arrangement of the so-called "ring spinning systems" provided to match several yarns in ring twisting equipments. Consequently, twists are emposed on each pair of binding yarns L1 and L2 in the span F1 between rollers 120 and the associated pressure rollers 90, and are thus delivered to the respective annular sliders 28. It will be noted that springs 96 bias feed rollers 120 to engage the outer concave surfaces of the profiled portions 64. The twists of the pairs of yarns L1 and L2 reach the contact points between each feed roller 120 and the associated pressure roller 90, and pass these contact points to extend along the grooves 90A and 120A. Practically speaking, the twists are present in each pair of yarns L1, L2 from the exit of these binding yarns from the nip represented by the periphery of each feed roller 120 and the adjacent outer concave surface of the respective profiled portion 64. Consequently, the sheared lengths E3 of the effect yarn E are trapped, by the twist between the two associated binding yarns L1 and L2, to form therewith the conventional chenille yarn which is unwound along the free span F1 to be wound on the respective bobbin 20 being formed on the corresponding spindle 14.

Pressure rollers 90 are biased by springs 89 in a direction to press against feed rollers 120, this pressure being maintained when rollers 120 undergo excursions about the respective pivots 91 of the supports 92, 92A, 94. Feed rollers 120 are stressed by springs 96 to press against the respective outwardly concave surfaces of the profiled portions 64 to engage the sheared lengths E3 of the effect yarn. When the operator desires to separate feed rollers 120 from the concave surfaces adjacent thereto, all that is necessary is to swing the operational arms 94 toward each other, in the direction indicated by the arrows *f*8, as seen in FIG. 5, and against the bias of springs 96.

The described machine is particularly efficient, has a smooth operation, and has a high output.

While a specific embodiment of the invention has been shown and described in detail to illustrate the application of the principles of the invention, it will be understood that the invention may be embodied otherwise without departing from such principles.

What is claimed is:

1. A machine for the production of pairs of chenille yarns, each formed by two binding yarns twisted together to bind therebetween short sheared lengths of an effect yarn, said machine comprising, in combination, an upright frame; respective forming units, for each pair of chenille yarns, mounted on said frame; a plurality of pairs of spindles mounted on said frame for rotation about substantially vertical axes, each pair of spindles receiving the chenille yarns from a respective forming unit; a horizontal bench mounted on said frame for vertical displacement relative to said spindles, and carrying annular tracks each coaxial with a respective spindle; respective annular sliders angularly displaceable on each track and entrainable by the yarn to be wound on the associated spindle; two pairs of binding yarn supplies, mounted on said frame, for forming each pair of chenille yarns; each forming unit including a respective control shaft rotatably mounted on said frame; motor means operable to rotate said control shafts; driving means interconnecting each control shaft and the associated pair of spindles to rotate the latter; a respective rotary bell member, for each forming unit, rotatably mounted on said frame, each bell member having an axial passage therethrough for a respective effect yarn and two guide bushes spaced radially from said axial passage and through which the respective effect yarn, threaded through said axial passage, is successively threaded in opposite radial directions; a respective winding and sizing member, for forming the sheared lengths of effect yarn, mounted on said frame beneath each rotary bell member; each winding and sizing member being formed by two spaced profile portions converging upwardly toward a leg portion and defining two outwardly facing concave surfaces merging with respective opposite surfaces of said leg portion, the profiled portions defining a slot therebetween extending into said leg portion; respective driving means connecting each bell member to the associated control shaft for rotation thereby; each effect yarn, by rotation of the associated bell member, being wound on the associated winding and sizing member to form turns around the leg portion thereof; a respective shearing blade disposed symmetrically in the slot between each pair of profiled portions and projecting into the associated leg portion to shear the turns of effect yarn wound on the latter to form, from each turn, two sheared lengths of effect yarn; a respective pair of feed rollers, for each forming unit, each engaged with a respective said concave surface to entrain a respective half of the sheared turns of effect yarns; means operable to feed, between each feed roller and the adjacent concave surface, a first one of the two binding yarns of each chenille yarn to overlie the respective halves of the sheared turns of effect yarn on such adjacent concave surface; each profiled portion having a hole therethrough opening into its concave surface; positive feed means operable to feed the second one of the two binding yarns of each chenille yarn through said hole of the respective profiled portion to underlie the respective halves of the sheared turns of the effect yarn on such concave surface; a respective supporting means for each feed roller oscillatably mounted on said frame; resilient means operatively associated with each supporting means and operable to bias the associated feed roller toward and into engagement with the adjacent said concave surface; a respective auxiliary roller, cooperable with each feed roller, rotatably mounted on each supporting means adjacent the lower end of the associated said concave surface; and means biasing each auxiliary roller toward the associated feed roller to exert a traction on the respective binding yarns; each feed roller and its associated auxiliary roller feeding the two respective binding yarns, between which the sheared lengths of effect yarn are engaged, over a free span to the associated annular slider for twisting of the two binding yarns about each other by cooperation of the associated spindle and annular slider.

2. A machine for the production of pairs of chenille yarns, as claimed in claim 1, in which each supporting means has a respective operational arm actuable to disengage the associated feed roller from its cooperating said concave surface.

3. A machine for the production of pairs of chenille yarns, as claimed in claim 2, in which each supporting means includes a link pivotally mounted intermediate its ends on said frame; each link carrying, at one end, a shaft rotatably mounting a respective auxiliary roller; each operational arm forming part of a rocker arm lever pivoted intermediate its ends on a respective shaft for an auxiliary roller and rotatably mounting, at its end opposite said operational arm, a respective feed roller; said resilient means operatively associated with each supporting means comprising respective tension springs connected between said frame and the outer ends of said operational arms and biasing said operational arms to swing in a direction to maintain the associated feed rollers engaged with the adjacent said concave surface.

4. A machine for the production of pairs of chenille yarns, as claimed in claim 3, in which said means biasing each auxiliary roller toward the associated feed roller comprises respective tension springs connected between said frame and the opposite ends of said links.

5. A machine for the production of pairs of chenille yarns, as claimed in claim 1, in which each feed roller is formed with an annular channel extending around its periphery to guide the associated binding thread; each auxiliary roller having axially spaced ribs around its periphery defining a channel whose width corresponds substantially to the sheared lengths of effect yarn.

6. A machine for the production of pairs of chenille yarns, as claimed in claim 1, in which the peripheral surface of each feed roller sliding on the associated said concave surface is formed with axially extending parallel grooves constituting knurls which extend transversely relative to the respective binding thread engaged with each said feed roller.

7. A machine for the production of pairs of chenille yarns, as claimed in claim 1, in which each bell member is formed with a depending cylindrical skirt; said guide bushes being mounted in axially spaced openings in said skirt; the effect yarn being fed radially outwardly through the upper guide bush and then radially inwardly through the lower guide bush to engage said winding and sizing member.

8. A machine for the production of pairs of chenille yarns, as claimed in claim 1, including a respective cam secured to rotate with each control shaft; and a respective cam follower connected to each shearing blade and engaged with the associated cam to reciprocate the shearing blade.

9. A machine for the production of pairs of chenille yarns, as claimed in claim 1, in which said positive feed means comprises a respective pair of feed rollers engaged with each second binding yarn; and driving means connecting said last-named pair of feed rollers to the associated control shaft for rotation thereby.

10. A machine for the production of pairs of chenille yarns, as claimed in claim 9, including a respective shaft secured to each first-mentioned feed roller and driven by said last-named driving means to rotate the associated feed roller.

* * * * *